US009643688B2

(12) United States Patent
Waldrop

(10) Patent No.: US 9,643,688 B2
(45) Date of Patent: May 9, 2017

(54) METHOD AND APPARATUS FOR A MOORING BEACON

(71) Applicant: Susan Waldrop, Vineyard Haven, MA (US)

(72) Inventor: Susan Waldrop, Vineyard Haven, MA (US)

( * ) Notice: Subject to any disclaimer, the term of this patent is extended or adjusted under 35 U.S.C. 154(b) by 269 days.

(21) Appl. No.: 14/272,822

(22) Filed: May 8, 2014

(65) Prior Publication Data

US 2015/0092402 A1 Apr. 2, 2015

Related U.S. Application Data

(60) Provisional application No. 61/885,090, filed on Oct. 1, 2013.

(51) Int. Cl.

| | |
|---|---|
| ***B63B 22/02*** | (2006.01) |
| ***E02B 3/24*** | (2006.01) |
| ***F21V 23/04*** | (2006.01) |
| ***F21S 9/02*** | (2006.01) |
| ***B63B 45/02*** | (2006.01) |
| *F21W 111/047* | (2006.01) |
| *F21Y 115/10* | (2016.01) |

(52) U.S. Cl.

CPC ..... *B63B 22/02* (2013.01); *B63B 45/02* (2013.01); *E02B 3/24* (2013.01); *F21S 9/02* (2013.01); *F21V 23/0407* (2013.01); *F21V 23/0435* (2013.01); *F21W 2111/047* (2013.01); *F21Y 2115/10* (2016.08)

(58) Field of Classification Search

CPC ..... B63B 22/116; B63B 45/02; B63B 45/04; B63B 45/06; B63B 51/04

See application file for complete search history.

(56) References Cited

U.S. PATENT DOCUMENTS 2,104,762 A * 1/1938 Riner ..... B63B 51/04 200/52 R
2,300,795 A * 11/1942 McAllister ..... B63C 9/21 200/52 A (Continued)

OTHER PUBLICATIONS

Vega Industries Ltd., VLB-67 LED Marine Beacon, Short Range Beacon 2-5NM at 0.74T/2.25-6NM at 0.85T, Dec. 10, 2013, p. 1-4, Vega Industries Ltd., Porirua, New Zealand.

(Continued)

*Primary Examiner* — Andrew Coughlin
(74) *Attorney, Agent, or Firm* — Hayes Soloway PC

(57) ABSTRACT

A remote controlled lighted mooring beacon is adapted to be secured to a mooring ball. The beacon includes a central shaft of a mooring stick. A ballast at the base of the shaft contains at least one battery which supplies the ballast for the mooring stick. A float surrounds a middle portion of the mooring stick and is located along the shaft between the top of the shaft and the ballast. An electronics package is located on the shaft including a receiver that responds to a wireless code for generating an activation signal. A 360 degree viewable high intensity light source is on top of the shaft, is daylight visible and is activated by the actuation. A conductor is connected from the at least one battery in the ballast to the electronics package and the light source for the powering thereof for at least one boating season.

10 Claims, 7 Drawing Sheets

(56) References Cited

U.S. PATENT DOCUMENTS

| | | | | | |
|---|---|---|---|---|---|
| 2,355,013 | A * | 8/1944 | Rochestle | B63B 51/04 | 200/232 |
| 3,453,670 | A * | 7/1969 | Conry | B63B 22/18 | 244/105 |
| 3,953,905 | A * | 5/1976 | Paitson | B63B 22/18 | 114/253 |
| 4,099,282 | A * | 7/1978 | Townsend | B63C 9/21 | 441/16 |
| 4,763,126 | A * | 8/1988 | Jawetz | G08G 3/00 | 340/985 |
| 4,896,620 | A * | 1/1990 | Jones | B63B 51/02 | 114/253 |
| 5,284,452 | A * | 2/1994 | Corona | B63B 22/026 | 114/230.21 |
| 5,890,794 | A * | 4/1999 | Abtahi | B60Q 7/00 | 362/183 |
| 8,127,702 | B2 * | 3/2012 | Scarcello | B63B 22/02 | 114/221 R |
| 2011/0304480 | A1 * | 12/2011 | Doria | B63B 22/02 | 340/984 |
| 2012/0326882 | A1 * | 12/2012 | Behm | G01S 1/70 | 340/686.6 |

OTHER PUBLICATIONS

Sealite, Products for Inland Waterways, http://www.sealite.com.au/sealite_inland_waterways_products.php.

* cited by examiner

METHOD AND APPARATUS FOR A MOORING BEACON

RELATED APPLICATIONS

This application claims rights under 35 USC §119(e) from U.S. Application Ser. No. 61/855,090 filed May 8, 2013, the contents of which are incorporated herein by reference.

FIELD

This invention relates to moorings and more particularly to a method and apparatus for locating a mooring by illuminating a high power light source atop a buoyed mooring stick in which the light source is under the control of a remote control transmitter, with the power source for the buoy including batteries forming the ballast for the buoy. The battery weight and size determines the ballast and provides for season-long operation.

BACKGROUND

It will be appreciated that sailing vessels such as sailboats and motorboats require a mooring or boat slip to attach to when coming into port. Leaving a mooring is not an issue. Rather finding the mooring again or finding a guest mooring at the end of a boating event is oftentimes a problem. Moorings may be marked by color, number or other indicia. However, regardless of whether the mooring is identified, it may not be viewable from a distance or may be obscured by fog or other boats in the area.

In broad daylight, experienced sailors who have identified their mooring location before departure, find it difficult to find the mooring after a race. Either the indicia was rotated away from view, or other boats had since moved, or the line-up with a land marker had shifted. And this problem locating a mooring happens in a field as small as about 30 moorings. Add to this basic dilemma a heavy breeze, a few extra boats all searching for their mooring, particularly as they all come in after a race, a larger more crowded mooring field, and there could be collisions from boats tacking in close quarters, all trying to find their moorings.

For instance, in Marblehead Harbor alone there are 2600 moorings, with the boats moored side-by-side with very little maneuvering room. When coming into the harbor it is oftentimes not possible to even see the mooring for which one is headed and certainly not to be able to identify it at any distance. This is even further complicated by fog or in driving rain such that it is oftentimes impossible to locate the correct mooring buoy. In such a situation ordinarily a boat has to circle the mooring field a number of times in order to be able to identify the correct mooring.

Some prior systems for indicating buoy location by lights atop the buoy are designed for buoys that carry large heavy battery packs recharged with wave action and are totally unsuitable for use as mooring sticks common with recreational boating moorings. These buoys are difficult to remove from the water at the end of the season and difficult to waterproof. Other prior systems for indicating mooring location by lights atop the mooring are designed to be powered by solar cell arrays. It will be appreciated that solar cells used to power illuminated buoys are too unwieldy to be conveniently plucked from the water. Other recreational boating devices that require wave action energy are simply too cumbersome for use on seasonal mooring sticks. Further, prior art lighted mooring sticks lack an adequate counterweight for keeping the stick upright.

For instance the system described in U.S. Pat. No. 4,763,126 does not carry the power source at the base of the mooring stick but rather locates the apparatus for powering the light in the buoyant central package midway up the mooring stick and thus provides no ballasting. U.S. Pat. No. 4,903,243 requires a rechargeable battery which either requires solar cells or wave action to recharge the battery. This type of system precludes its use on a mooring stick.

It will be appreciated that long life for a lighted mooring beacon is important so that it can last an entire boating season without battery replacement. This is because access to the mooring is not convenient in many instances and battery replacement or recharging is a nuisance. This power problem is particularly severe when one attempts to utilize a high intensity strobe light to identify the position of a mooring stick. Without a significant power source that can operate for a whole boating season, strobe-based systems are not useful in mooring beacons.

It is therefore important to provide a mooring beacon with a very high intensity 360° viewable light source on top of a mooring stick that can be viewed from far away and yet has enough power in reserve so that the mooring beacon can be installed and used for entire boating season.

SUMMARY OF THE INVENTION

The subject method and apparatus for identifying a mooring solves the above-mentioned problems by providing a remote controlled mooring beacon having a 360 degree viewable high intensity light source atop a buoyed mooring stick in which the mooring stick is ballasted by a battery pack at its lower end, with the batteries being of sufficient size to last an entire boating season. The batteries are also of sufficient weight to provide enough ballast so that the mooring stick stays upright even in heavy seas. Note the entire mooring beacon is waterproof. The subject mooring beacon allows the boat owner to plan his approach to the mooring field with sufficient time to prevent dangerous, quick and unexpected turns in tight places, with the mooring beacon seen easily.

More particularly, the batteries replace the traditional lead weight at the bottom of a mooring stick. With the heavy batteries at the base of the mooring stick and with a buoyant float in the middle portion, the large batteries permit not only season-long powering of a very high intensity light source for identifying the location of the mooring stick, but also provide ballasting of the mooring stick even in heavy seas. In one embodiment, the batteries weigh 4-5 pounds. The mooring stick itself may extend approximately 3 feet above the buoyant float and approximately 1 foot below the buoyant float. With this configuration the batteries create a sufficient righting moment.

The light atop the mooring stick is a powerful 360 degree-viewable light source which is turned on by remote control signals transmitted to a receiver carried by the mooring beacon from a transponder set to the individual frequency or code assigned to the mooring beacon, with the mooring beacon actuatable from up to three quarters of a mile away.

It will be appreciated that the high intensity light source in one embodiment can be a strobe light which is viewable for instance up to a mile from the mooring. Alternatively, the high intensity light source can be formed from an array of LED lamps arranged in so that they point in varying directions for 360 degree coverage. If the individual LEDs are insufficiently bright to provide for the requisite illumination, multiple LEDs can be packaged in a module. These modules are then arranged to provide the required 360 degree coverage. Each of these modules may contain for instance from 3 to 20 individual LED lamps to provide for the requisite intensity. Commonly available LED lights only point in one direction and do not provide 360 degree coverage. However with multiple LEDs arranged as described above, the subject mooring beacon is readily viewable in bright sunlight, at night and in fog.

Moreover, in one embodiment, the mooring beacon receiver can be turned off completely when stored and automatically turns off the high intensity light source after a predetermined period of time to minimize battery drainage. Further, a beeping sound system can be attached as desired and timed with the flashing light source.

The subject beacon system can also be used in harbors where the harbor master controls the use of guest moorings. Rather than pointing the customer in the vague direction of the intended mooring, a transponder could be taken from a rack containing one for each mooring. Then upon actuation by the harbormaster, the customer could sail or motor to the illuminated mooring with assurance that he or she is finding the right mooring. A rack of transponders can also be a handy reference to the harbormaster to see at a glance which moorings have been rented by noting the transponder that is out of the rack.

In addition the subject beacon system can be used to locate boat slips for the owner or guest so that they may safely navigate into the slip by themselves. Since many such slips look alike even to an owner, it is important to be able to identify the correct slip so that the boated can enter the correct slip.

When the mooring beacon light is placed at a slip, the beacon can be remotely activated from a boat or by a dockmaster to indicate which slip is available. When numbers of boats are coming in for dock space, only one mooring beacon is activated at a time by the dockmaster who can selectively address the mooring beacons and then extinguish them after a boat is successfully docked. Also the individual beacons can be either color-coded or flashed in a coded fashion to indicate to an incoming boater which slip he or she is to enter.

Additional advantages to the use of the subject device is to prevent boat collisions and in changing weather conditions and in crowded harbors. Also accidental misuse of another's mooring which requires a harbormaster to come out and a move boats off a mooring is avoided. The subject device also serves as an aid to the accurate location of moorings and boat slips. Thus the subject mooring beacon can be a valuable safety and navigational tool for the boating consumer.

Note, when the mooring beacon is used as a mooring stick, it is tethered to a mooring ball by a chain. A user should be able to grab the mooring stick and move it onto the boat so that the chain is decleated.

In summary, a floatable remote-controllable mooring beacon is provided that incorporates either a 360 degree array of high intensity LEDS or a high-intensity flash lamp on the top of a mooring stick, with the mooring stick ballasted by the batteries used to power the mooring beacon for the entire boating season.

BRIEF DESCRIPTION OF THE DRAWINGS

These and other features of the disclosure will be better understood in connection with the Detailed Description in conjunction with the Drawings.

DETAILED DESCRIPTION

Figure 1:
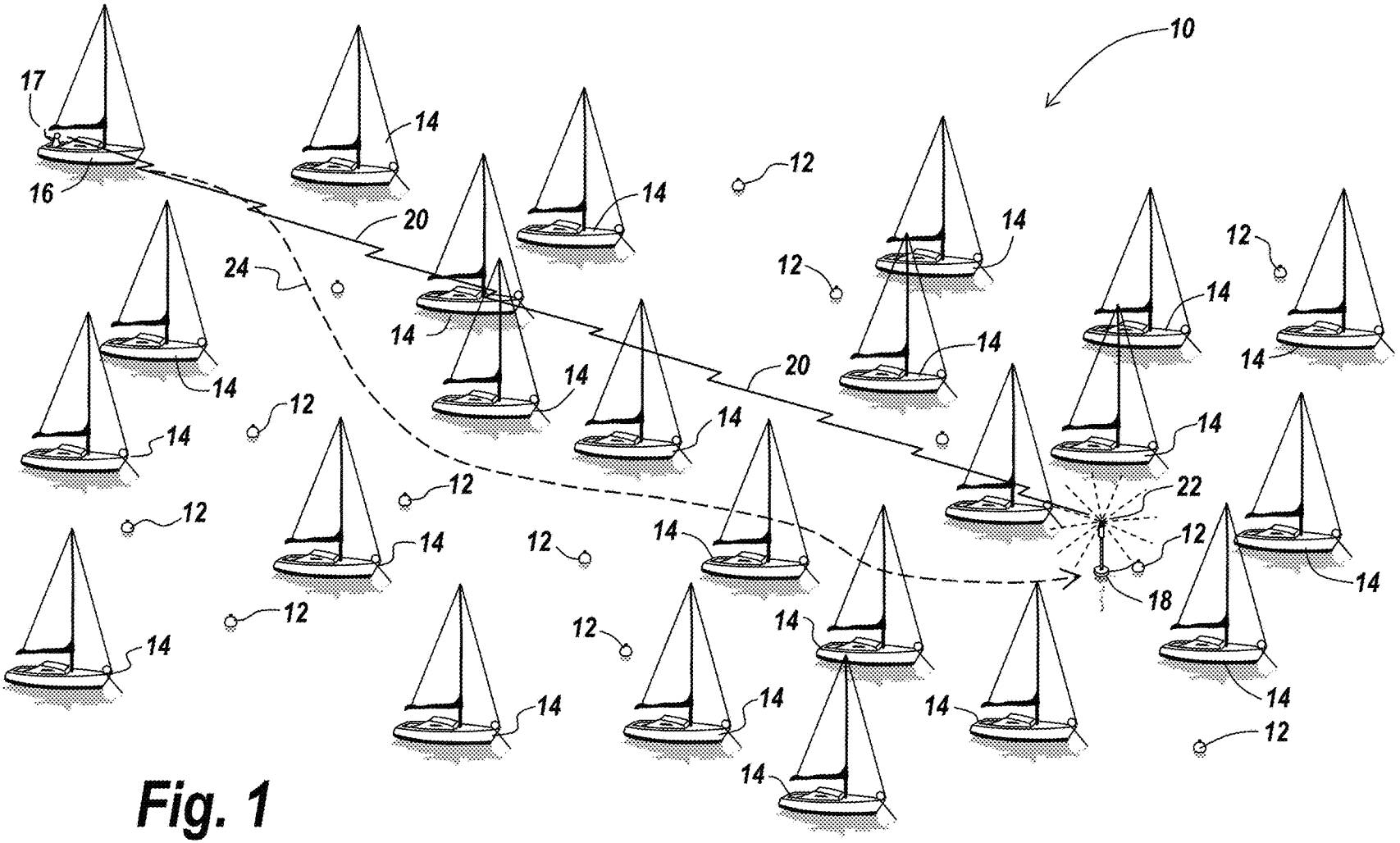
FIG. 1 is a diagrammatic illustration of the entry of a boat into a harbor searching for a mooring with an individual on the boat signaling the mooring beacon to illuminate, thereby to indicate the direction and placement of the mooring.

Referring now to FIG. 1, a crowded harbor 10 is shown having a number of mooring balls 12 located throughout the harbor to which sailing vessels 14 are moored. It will be seen that due to the densely packed harbor it is very difficult for an incoming vessel 16 to be able to locate a particular mooring ball, here shown at 18, due to the number of boats in the way and due to the similarity of all of the mooring balls 12.

While the moorings themselves are numbered or provided with other indicia and while if the boater is familiar with the harbor and knows the location of boats adjacent his mooring, it is still nonetheless difficult at times for the boater to ascertain which mooring is his. The problem exacerbated when boats that usually sit around his mooring have left their moorings. Thus there is no visual cue as to which of the many moorings in the crowded mooring field is the boater's mooring.

In order for the mooring beacon 18 to be identified, a boater on a vessel 16 activates the transponder 17 to wirelessly activate the associated mooring beacon 18 through an transmission 20 which causes a high intensity light source 22 to illuminate. This illumination may be visible for at least 100 yards and permits the boater to maneuver his vessel as illustrated by the dotted line 24 towards his mooring beacon 18.

The mooring beacon 18 is of sufficient intensity and omnidirectionality that regardless of the crowding of the harbor and orientation of the mooring beacon, the mooring beacon is easily visible not only at night but also in fog and during the day.

Figure 2:
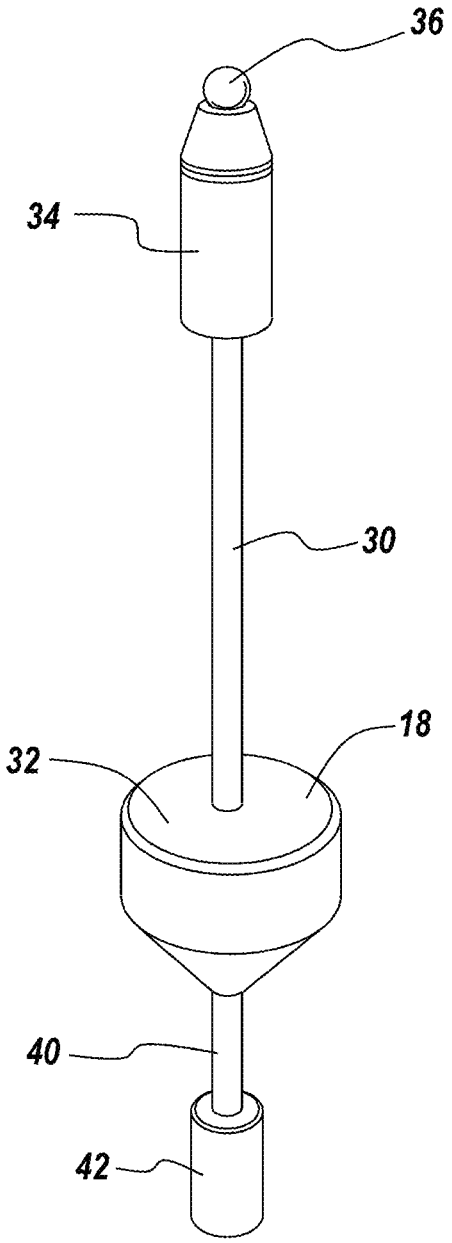
FIG. 2 is a diagrammatic illustration of the mooring beacon of FIG. 1, indicating the extension of a shaft above a float carrying a receiver package and a high-intensity light source capable of being viewed 360 degrees.

As illustrated in FIG. 2, the mooring beacon 18 is comprised of a shaft 30 that extends through a float 32 in and carries a receiver unit 34 adapted to receive the wireless signals from the wireless transmitter on a vessel entering the harbor. This signal may be coded such that the only mooring beacon 18 that has its high power light source activated is the one that corresponds in code or frequency to the transponder actuated. On top of the receiver housing is a high intensity omnidirectional light source 36 which is visible at large distances due to the high intensity of the light source 36, be it a strobe light in one embodiment or a plurality of LEDs aimed around the compass points to provide 360° coverage. The bottom portion 40 of the shaft 30 is provided with a battery package 42 which will be described hereinafter but whose function is not only to power the mooring beacon 18 but also to provide a ballast to make sure that the shaft 30 is in an upright position as it floats on the surface the ocean or lake.

Figure 3:
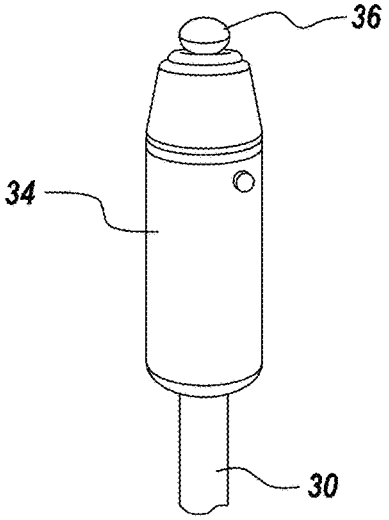
FIG. 3 is a diagrammatic illustration of the top portion of the mooring beacon of FIG. 2 illustrating the encapsulation of a receiver and the placement of a high intensity strobe light atop the shaft.

Referring to FIG. 3, the upper portion of the mooring beacon 18 of FIG. 2 is shown in which at the top of the shaft 30 is a waterproof housing 34 which carries a receiver for receiving coded signals from a transponder. Housing 34 also includes switching circuits for connecting the power from the battery package 42 carried at the base of the shaft 30 to both the receiver within housing 34 and also to the high intensity light source 36 which is illustrated as a flash lamp strobe. The receiver may be a conventional receiver such as found in garage door openers along with conventional switches normally used in such applications.

It be appreciated that the housing and all components are made waterproof so that they will operate at least for a season and longer. The components may be hermetically sealed.

Referring back to FIG. 2, in one embodiment, the shaft 30 and attendant hardware performs the function of a mooring stick which is attached to a mooring ball by a chain. After the boater identifies his mooring and comes up to it, he may pluck the mooring stick out of the water and secure the mooring ball to a bow cleat. Is important to note that the weight of the entire mooring with shaft 30, high intensity light source 36, receiver 34 and battery package 42 is kept under 10 pounds, and preferably lighter so that it may be easily brought aboard the boat.

Figure 4:
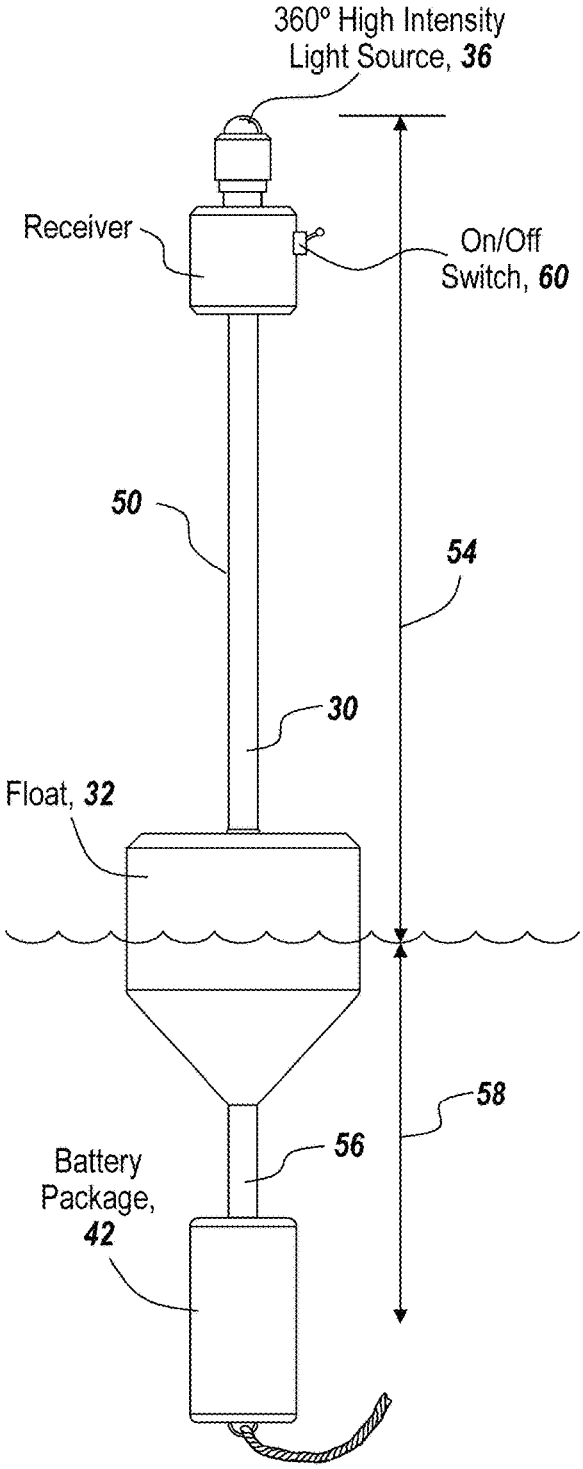
FIG. 4 is a diagrammatic illustration showing the utilization of a battery package to ballast the mooring beacon of FIG. 1, with the shaft being utilized as a mooring stick and having a float and the receiver/light assembly on the shaft, showing the relative length of the shaft extending below the float and the relative length of the shaft extending above the float, thus to raise up the high intensity light source to give maximal visibility for the beacon while at the same time providing an appropriate righting moment for the mooring beacon due to the battery package at the bottom of the shaft.

More particularly, and referring now to FIG. 4, the shaft 30 is shown to pass through the float 32 such that an upper portion 50 extends upwardly from the float 32 by a distance illustrated by arrow 54 of approximately 3 feet in one embodiment. Beneath the float is a portion of the shaft 56 having a battery package 42 secured to the distal end of shaft 30, with shaft portion 56 extending as illustrated by arrow 58 1 to 2 feet below the float 32. In one embodiment, the weight of the battery package is between 4 and 10 pounds to give sufficient righting moment to the mooring such that it remains upright in all sea conditions.

Figure 7:
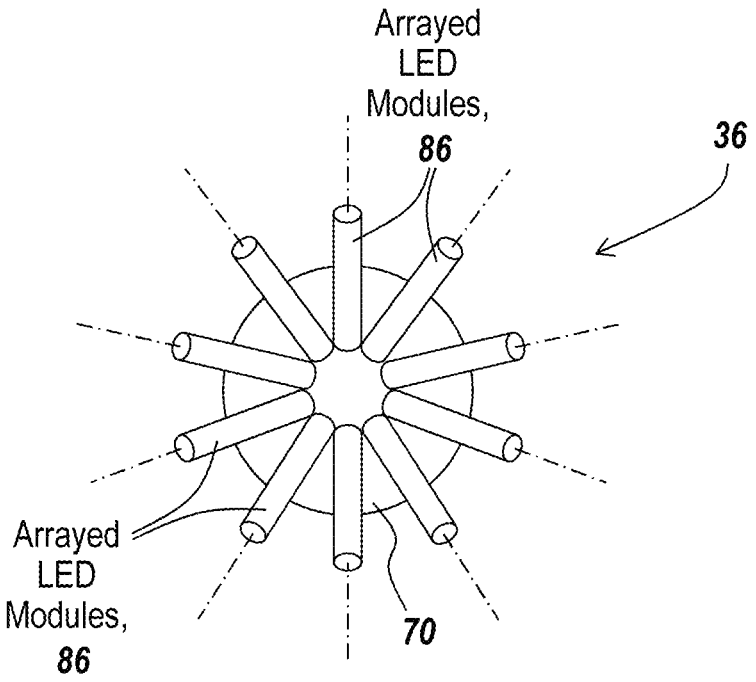
FIG. 7 is a diagrammatic illustration of the utilization of a number of LED modules mounted in a circle and aimed in different directions to provide 360° high intensity coverage for the mooring beacon of FIGS. 1, 2 and 3.

The mooring beacon 18 is provided with an on-off switch 60 such that the mooring beacon can be actuated when placed adjacent a mooring ball. Here it will be seen that the 360 degree high intensity light source 36 may be in the form of a strobe light which is visible for a mile or more. Alternatively, and as shown in FIG. 7, the high intensity light source may be made of a plurality of light emitting diodes mounted around the periphery of a circular support so that they face outwardly and provide 360 degree visibility. If the individual light emitting diodes are not sufficiently intense, they may be located in mini flashlight modules such that the light emitted in one direction is spread out by the number flash light modules. Note that each flashlight module may incorporate a number of LEDs. The LEDs may be programmed to blink in a strobe-like manner to be easily visible. The LEDs may be programmed to blink a finite number of times, such as not more than 5 blinks for a single activation. Controlling the blinking limits light pollution in the harbor.

Figure 5:
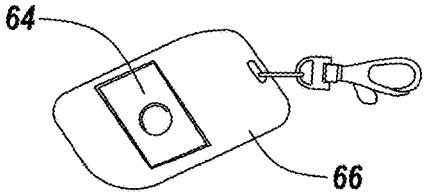
FIG. 5 is a diagrammatic illustration of a handheld transponder for use by a mariner on a boat seeking to activate the mooring beacon of FIGS. 1, 2 and 3.

As illustrated in FIG. 5 a typical transponder 62 is shown with an activation button 64 to cause the transponder 62 to transmit a coded signal which is picked up by the mooring beacon 18.

Figure 6:
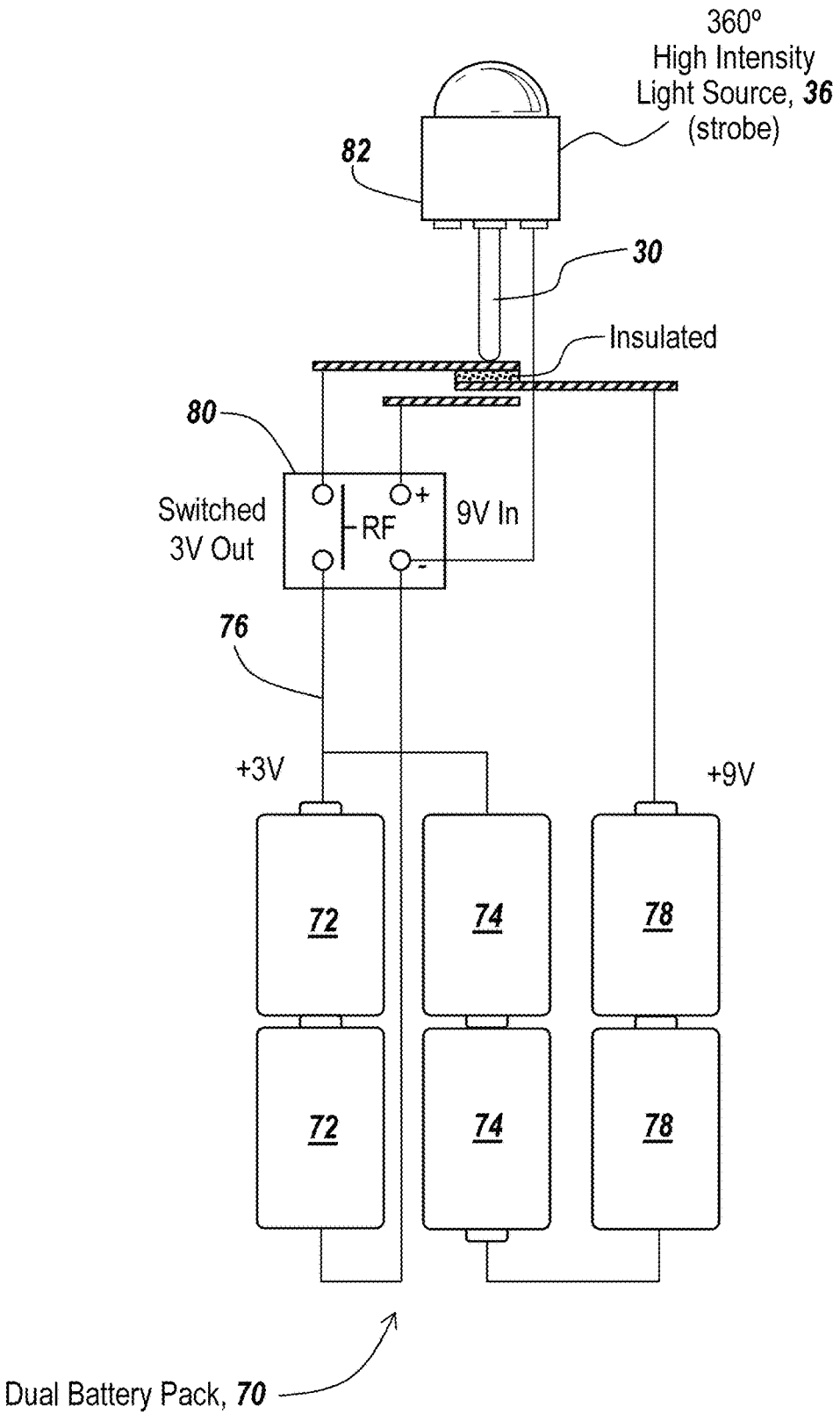
FIG. 6 is a diagrammatic illustration of a dual battery pack assembly for use in the mooring beacon of FIGS. 1, 2 and 3, showing a low voltage source to power the receiver in the mooring beacon and a higher voltage source to power a high intensity light source.

Referring now to FIG. 6, a dual battery pack 70 includes a pair of batteries 72 connected in series, the output of which is 3 V and a number of batteries 74 connected in series to produce a combined output of 9 V. The output from the low voltage source over is coupled to a switch module 80 which is activated by a receiver 34 (not shown in this figure) so that under normal operation the low-voltage 3 V is applied to a receiver 34 mounted atop the shaft 30.

When the mooring is actuated by a remote RF signal, switch module 80 connects the high-voltage from batteries 74 to power the high intensity light source 36. When this light source 36 is a strobe as illustrated, its power drain is significant and requires the higher voltage to sustain his high power output.

However, as illustrated in FIG. 7, if the high intensity light source 36 may be comprised of LED modules 86 each pointed in a different direction around a periphery, then the drain on battery 74 may be significantly reduced while at the same time providing for the required high intensity omnidirectional output. As mentioned above, if individual light emitting diodes mounted around the periphery of a support, for instance support 90, are insufficiently bright to provide visibility over long ranges, aggregates of LEDs may be mounted in modules to provide high intensity light in one direction. In this case a number of these modules may be arrayed around in a circle on support 90 such that while the beam width is relatively narrow for each of these modules, the use of multiple modules pointing in different directions permits omnidirectional high intensity light to be propagated out across the harbor.

Figure 8A:
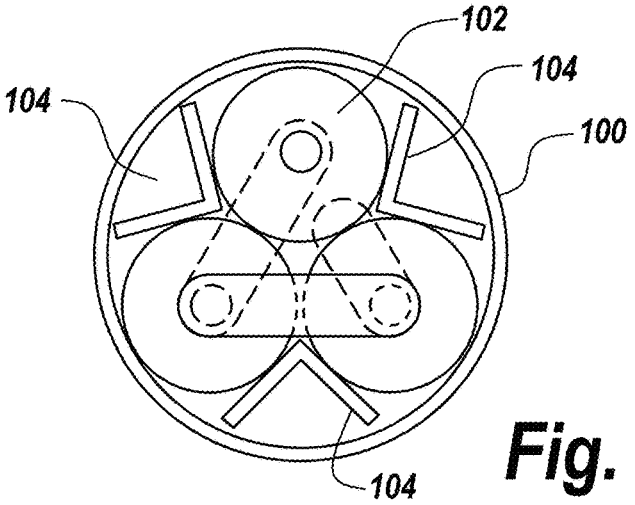
FIG. 8A is a top view of the location of batteries in a cylindrical housing for use in the battery package of FIG. 3.
Figure 8B:
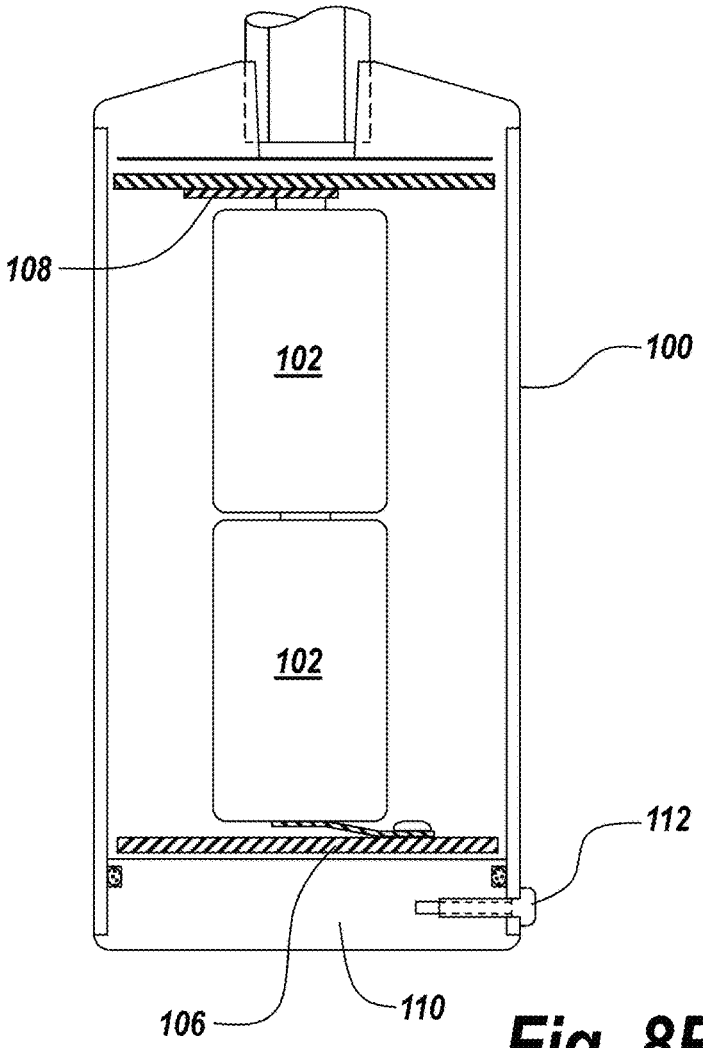
FIG. 8B is a side view of the placement of batteries within the battery package of FIG. 8A.

Referring now to FIG. 8A, in one embodiment, a housing 100 houses a number of cylindrical batteries 102 in a triangular configuration. The batteries are kept in place by spacers 104 so as to make sure they do not become dislodged. Referring to FIG. 8B, housing 100 is shown with batteries 102 mounted vertically within the housing and connected by contacts 106 and 108 to keep the batteries in place. The batteries may be replaced through a lower portion 110 of housing 100 which is anchored in place through a pin or screw 112. In another embodiment, a single battery may be utilized to power the mooring beacon 18, if sized properly. The battery or batteries forming the ballast of the mooring beacon 18 may be rechargeable and may be recharged from a connection port (not shown) mounted at an upper portion 50 of the shaft 30.

It will be appreciated that what is provided is a mooring beacon which floats next to a mooring ball and is tethered thereto such that the mooring beacon is actuated remotely by transponder and is provided with a high intensity omnidirectional light source visible over large distances, thus to be able to identify the particular mooring for the boater seeking to moor his boat. In one embodiment, the receiver utilized to activate the high intensity light source turns off the high intensity light source after predetermined time so as to minimize battery drain.

With the batteries located at the distal end of the shaft of the mooring beacon and since these batteries must of necessity weigh enough to keep the mooring shaft vertically oriented, these batteries are designed not only to ballast the mooring beacon but also to permit season-long usage of the mooring beacon without replacement. It is noted that for marine use, all of the above components are waterproof and sealed such that corrosion is avoided as well as internal shorting for the components of the mooring beacon.

While the above operation has been described in connection with mooring balls, it will be appreciated that this floating device may be anchored to a pier or dock slip to indicate to an incoming boater where he or she is to dock his vessel. The actuation of the mooring beacon is the same as discussed hereinbefore. Moreover, these mooring beacons can be actuated for instance by a dockmaster or harbormaster to indicate which of the slips is available for use. In this case, the remote control unit is utilized to actuate a particular mooring beacon, which actuation is under the control of the harbormaster or dockmaster instead of the operator of the vessel.

Figure 9:
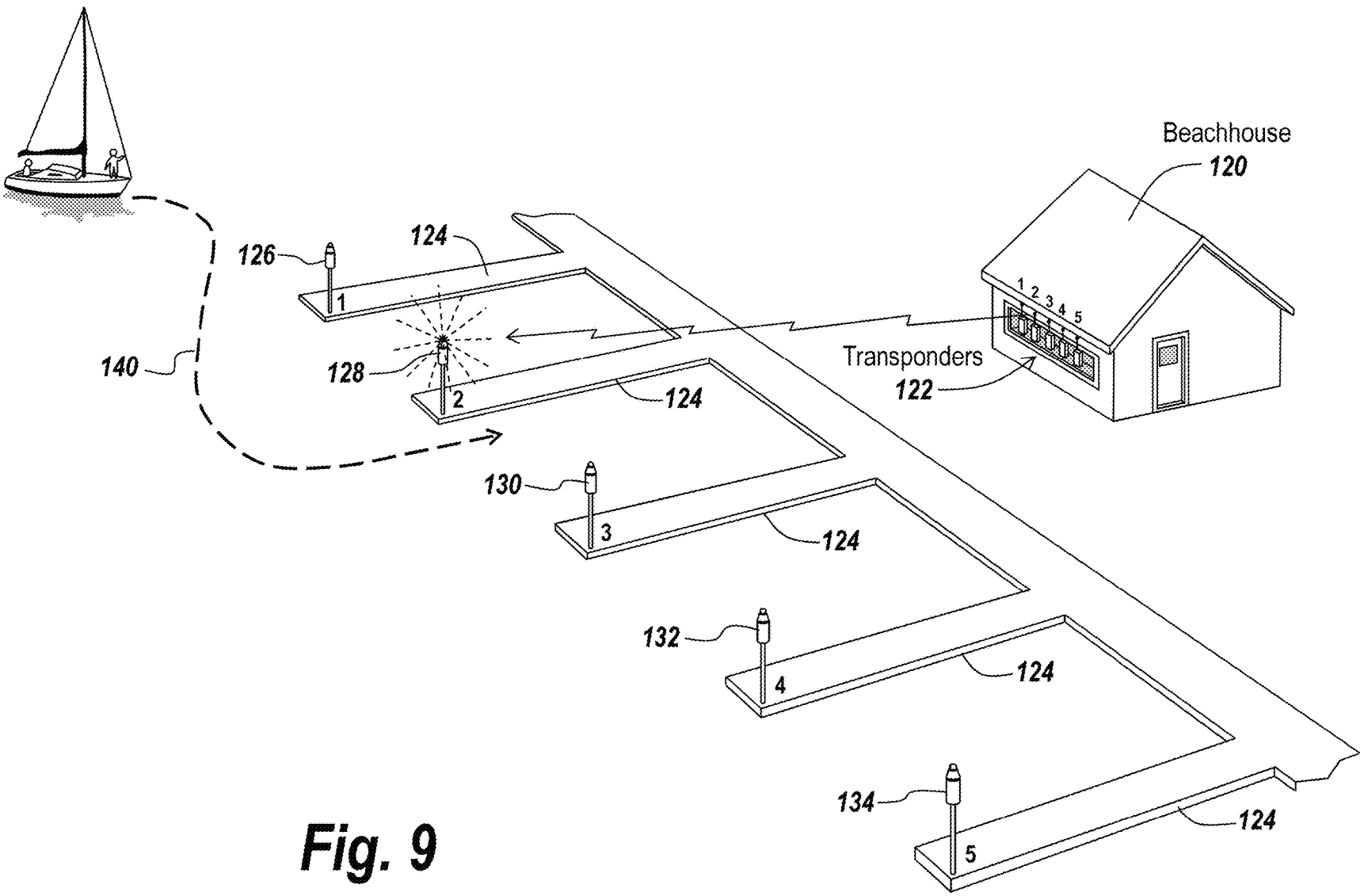
FIG. 9 is a diagrammatic illustration of the utilization of the subject remote controllable beacon to indicate which of a plurality of docks is indicated as being available for an incoming vessel under the control of a dockmaster.

More particularly, and referring now to FIG. 9, it will be seen that a dock house 120 is provided with a number of transponders 122. These transponders correspond to docks 1-5, with the transponders forming a head end control system and actuated to actuate a corresponding high intensity light source at the end of the appropriate dock. Here a number of docks 124 are illustrated as being Docks 1, 2, 3, 4, 5. At the end of each of these docks is an illuminable remote-controllable light source on a pole such as indicated at 126, 128, 130, 132 and 134. When the dockmaster wishes to indicate that the that Dock Number 2 is available, he activates the transponder 122 corresponding to Dock Number 2, at which point the high intensity light source at 128 is illuminated to indicate the dock to which a boater is to tie up. Thus, the vessel travels along dotted line 140 to the near side of Dock Number 2 as illustrated.

In this manner the dockmaster or harbormaster can indicate which dock is available for an incoming vessel. In this case either the mooring beacon can be floated at the end of the dock or the shaft portion merely physically attached to the end of the dock, with the operation of the beacon being as mentioned hereinbefore.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A remote controlled lighted mooring beacon adapted to be secured to a mooring ball, comprising:

a central shaft of a mooring stick;

a ballast at the base of said shaft containing at least one battery which supplies the ballast for the mooring stick;

a float surrounding a middle portion of the mooring stick and located along said shaft between the top of said shaft and said ballast;

a 360 degree viewable high intensity light source on top of said shaft being daylight visible and activated by an actuation signal;

an electronics package located on said shaft including a receiver that responds to a wireless code for generating the activation signal, wherein the electronics package is configured to allow a user to program the high intensity light source to change from a first flash sequence to emit a second flash sequence, wherein the first flash sequence is different than the second flash sequence; and a conductor connected from the at least one battery in said ballast to said electronics package and light source for the powering thereof.

2. The beacon of claim 1, further comprising a transmitter for transmitting the wireless code to said electronics package for the activation of said high intensity light source.

3. The beacon of claim 1, wherein said ballast consists of the at least one battery.

4. The beacon of claim 1, wherein said shaft has sufficient strength to carry said electronics package and is long enough for retrieving said mooring beacon.

5. The beacon of claim 1, wherein said electronics package, high intensity light source and ballast containing said batteries are waterproof.

6. The beacon of claim 1, wherein said ballasting batteries have a battery life sufficient to power said high intensity light source in intermittent usage for at least one boating season, wherein one boating season lasts up to one year.

7. The beacon of claim 1, and further including a power switch on said electronics package for disconnecting the power from said battery to said electronics package to conserve power.

8. The beacon of claim 1, wherein the central shaft is at least four feet long and the beacon weighs less than ten pounds.

9. The beacon of claim 1, wherein the electronics package comprises the first flash sequence configured to emit a flash sequence of no more than five flashes for a single activation.

10. The beacon of claim 1, wherein the 360 degree viewable high intensity light source further comprises one of a plurality of colors.

* * * * *